US005082192A

United States Patent [19]

Langen et al.

[11] Patent Number: 5,082,192

[45] Date of Patent: Jan. 21, 1992

[54] APPARATUS FOR DELIVERING INDIVIDUAL PACKAGES OR GROUPS THEREOF TO A PACKAGE TRANSPORT SYSTEM

[75] Inventors: Manfred Langen; Gregor Gebald, both of Moenchengladbach; Siegfried Inger, Krefeld; Manfred Schroeders, Moenchengladbach, all of Fed. Rep. of Germany

[73] Assignee: Palitex Project Company GmbH, Krefeld, Fed. Rep. of Germany

[21] Appl. No.: 483,019

[22] Filed: Feb. 21, 1990

[30] Foreign Application Priority Data

Mar. 4, 1989 [DE] Fed. Rep. of Germany ..... 3906950

[51] Int. Cl.[5] ..... B65H 54/00; B65H 67/06

[52] U.S. Cl. ..... 242/18 R; 198/409; 198/465.4; 242/1; 242/18 EW; 242/35.5 A

[58] Field of Search ..... 242/35.5 A, 35.5 R, 242/18 EW, 35.6 E, 18 R, 1, 47; 198/409, 465.4

[56] References Cited

U.S. PATENT DOCUMENTS

| | | | |
|---|---|---|---|
| 4,138,072 | 2/1979 | Aoyama et al. | 242/35.5 A |
| 4,153,211 | 5/1979 | Lenk et al. | 242/35.5 A |
| 4,657,194 | 4/1987 | Wey et al. | 242/35.5 A |
| 4,721,262 | 1/1988 | Langen | 242/35.5 A |
| 4,783,021 | 11/1988 | Nagasawa | 242/35.5 A |
| 4,832,281 | 5/1989 | Payne, Jr. et al. | 242/18 EW |
| 4,924,999 | 5/1990 | Kikuchi | 242/35.5 A |
| 4,925,000 | 5/1990 | Pacakova et al. | 242/35.5 A |
| 4,944,146 | 7/1990 | Scaglia | 242/35.5 A |

FOREIGN PATENT DOCUMENTS

| | | |
|---|---|---|
| 0026160 | 7/1984 | European Pat. Off. . |
| 0113126 | 7/1984 | European Pat. Off. . |
| 2227105 | 12/1973 | Fed. Rep. of Germany . |
| 3240822 | 5/1984 | Fed. Rep. of Germany . |
| 3244925 | 6/1984 | Fed. Rep. of Germany . |
| 3246463 | 6/1984 | Fed. Rep. of Germany . |
| 3737122 | 8/1988 | Fed. Rep. of Germany . |
| 3802900 | 8/1988 | Fed. Rep. of Germany . |
| 3825273 | 2/1989 | Fed. Rep. of Germany . |

*Primary Examiner*—Stanley N. Gilreath
*Attorney, Agent, or Firm*—Bell, Seltzer, Park & Gibson

[57] ABSTRACT

A yarn package transfer apparatus is provided which includes devices for removing hollow yarn package adapter devices from downwardly and generally vertically-extending package holders movably and serially-mounted on an overhead conveying system, for inserting such hollow adapter devices into the hollow tubes of a desired number of yarn packages positioned in a generally horizontal position in a package supply assembly, and for transferring such packages of yarn from the package supply assembly and mounting the hollow adapter devices and yarn packages carried thereby onto the vertically-extending package holders of the overhead conveying system for conveying of the yarn packages. The apparatus preferably includes devices for positioning the loose ends of the yarn from the yarn packages on the adapter device in desired positions during the transferring operation.

16 Claims, 6 Drawing Sheets

APPARATUS FOR DELIVERING INDIVIDUAL PACKAGES OR GROUPS THEREOF TO A PACKAGE TRANSPORT SYSTEM

FIELD OF THE INVENTION

The invention relates to yarn package transfer apparatus which preferably includes devices for positioning loose ends of yarn from the yarn packages in positions for convenient subsequent use. It refers in particular to an apparatus for receiving fully wound packages, which are produced, for example, on an automatic winding machine, and for delivering same to a package transport system, which supplies these packages, depending on their later use, to a further processing machine, such as, for example, a two-for-one twisting machine.

BACKGROUND OF THE INVENTION

This general type of apparatus is described in European Patent EP 0 026 160. This known apparatus serves to combine two individual packages axially aligned and one following the other by means of a package adapter to a group of packages, which are subsequently caused to drop under the influence of gravity into a storage or a collection buggy. Before doing so, the individual package adapters are removed from a package magazine. For their further processing, it is necessary to retrieve the package units deposited in the storage or collection buggy. In practice, such a removal is suitably done only by hand so as to protect the package units.

German Offenlegungsschrift DE-OS 38 02 900 deals with an apparatus for delivering or transferring packages so as to link an automatic winding machine to a two-for-one twisting machine More specifically, an apparatus is disclosed therein, in which the packages are removed by a gripper from a conveyor belt and delivered, after their axial position has been changed, to package carriers of a conveyor belt moving around a two-for-one twisting machine.

SUMMARY OF THE INVENTION

In contrast thereto, the apparatus of the present invention creates the possibility of picking up and conveying packages from an automatic winding machine by means of an adapter in such a manner that they can be delivered as a unit combined by the package adapter to a further processing machine. In particular, the delivering or transferring apparatus is also characterized in that package adapters, which have become free in region of the further processing machine, can be used again for receiving individual packages or groups thereof, in that the freed or emptied package adapters are again returned by an overhead conveying system, which has previously transported the units comprising packages and adapters to the region of the further processing machine, to the region of a lifting cylinder device mounted on a rotary knob.

Thus, the solution of the present invention substantially comprises an association of a package transport system to a package delivering or transferring station such that empty package adapters returning from the further processing machine are received, subsequently loaded with fully wound packages, and again transferred to the package transport system and returned to the region of the further processing machine.

More specifically, the yarn package transfer apparatus in accordance with this invention includes means for removing hollow yarn package adapter devices from downwardly and generally vertically-extending package holders movably and serially mounted on an overhead conveying system, for inserting such hollow adapter devices into the hollow tubes of a desired number of yarn packages positioned in a generally horizontal position in a package supply assembly, and for transferring such packages of yarn from the package supply assembly and mounting the hollow adapter devices and yarn packages carried thereby onto the vertically-extending package holder of the overhead conveying system for conveying the yarn packages, and means for positioning the loose ends of yarn from the yarn packages on the adapter device in desired positions during the transferring operation.

Preferably, each of the hollow yarn package adapter devices includes inside surfaces extending obliquely and/or spirally and terminating in a downwardly-extending open groove, an entrance opening in the outside surface at the upper end thereof which protrudes beyond the yarn packages carried thereby, a yarn channel extending at one end from the entrance opening generally circumferentially through the wall of the adapter device and an exit opening communicating with the other end of the yarn channel.

The means for transferring the yarn packages preferably includes a generally vertically oriented stationary column and slide means mounted thereon for upward and downward movement, a knob means mounted on the slide means for movement therewith and for rotating movement with respect thereto, a cylinder and lifting element means mounted thereon for advancing and retracting movement and being carried by the knob means for rotating movement between a generally vertically-oriented position and a generally horizontally-oriented position and having carrier means on an outer end of the lifting element means for removably receiving and carrying the adapter device.

The means for positioning the loose ends of yarn preferably includes first means for grasping and holding the loose yarn ends from the yarn packages on the adapter device, second means for transferring the held yarn ends from the first means to the entrance opening at the upper end of the adapter device and third means for threading the loose ends of the yarn through the yarn channel and out of the exit opening. The first means preferably comprises means for rotating the package adapter device carrier means for desired positioning of the yarn package on the adapter device and suction means positioned with respect to the package adapter carrier device when the cylinder and lifting element means are in the generally vertically-oriented position for grasping and holding the loose ends of the yarn from the yarn packages which have been positioned by the rotating means. The second means preferably comprises entrainment means for carrying the yarn from the suction means of the first means and clamp means for receiving the yarn from the entrainment means, clamping the yarn and carrying the yarn ends from the suction means of the first means to the entrance opening of the yarn channel at the upper end of the adapter device. The third means for threading the loose ends of yarn through the yarn channel and out of the exit opening preferably comprises movable suction nozzle means adapted to be moved into and out of engagement with the exit opening of the yarn channel in the adapter device for applying a suction through the yarn channel and the yarn entrance opening for threading of the yarn ends therethrough.

The suction nozzle means preferably includes a hollow interior for receiving the loose yarn ends threaded through the yarn channel of the adapter device and further includes cutting means positioned within the suction nozzle means for cutting the loose ends received therein to provide uniform lengths of the cut yarn ends threaded through the adapter device. Preferably, a pin extends from the surface of the mandrel of the package adapter device carrier in a generally radial direction for cooperation with the inside guide surfaces inn the hollow adapter device to position the adapter device in a defined angular position to place the yarn entrance opening of the yarn passageway in a desired position to receive the yarn ends from the yarn clamp of the second means of the yarn end positioning means and to position the exit opening for engagement by the suction nozzle means of the third means of the yarn end positioning means.

BRIEF DESCRIPTION OF THE DRAWINGS

The invention will be described in more detail hereinbelow with reference to the drawing, in which —

DETAILED DESCRIPTION OF THE PREFERRED EMBODIMENT OF THE INVENTION

The working principle will now be described with reference to FIGS. 2–4.

Figure 2:
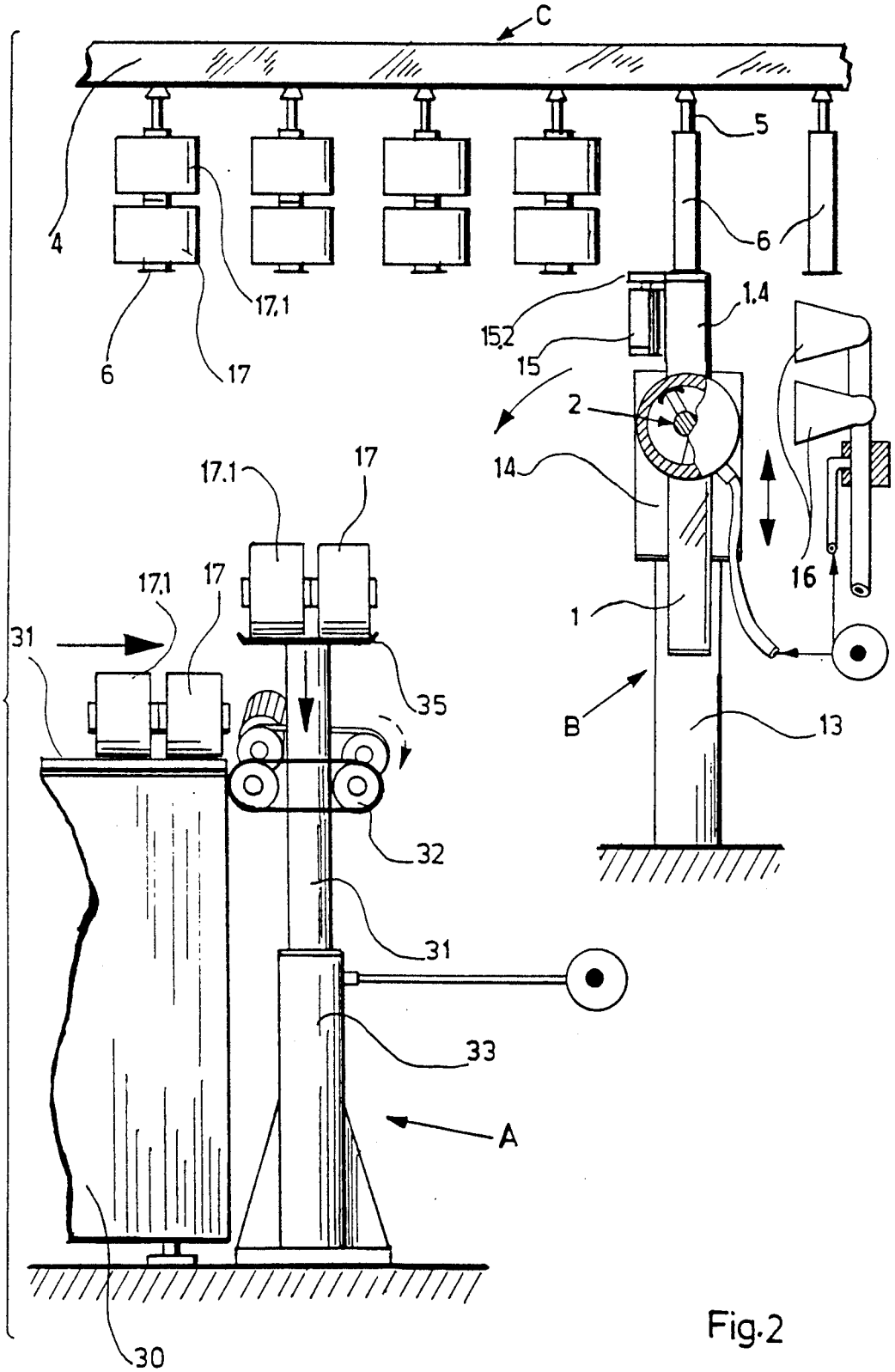
FIG. 2 is a schematic side view of a the apparatus of the present invention in a first working position with a preceding package repository.
Figure 3:
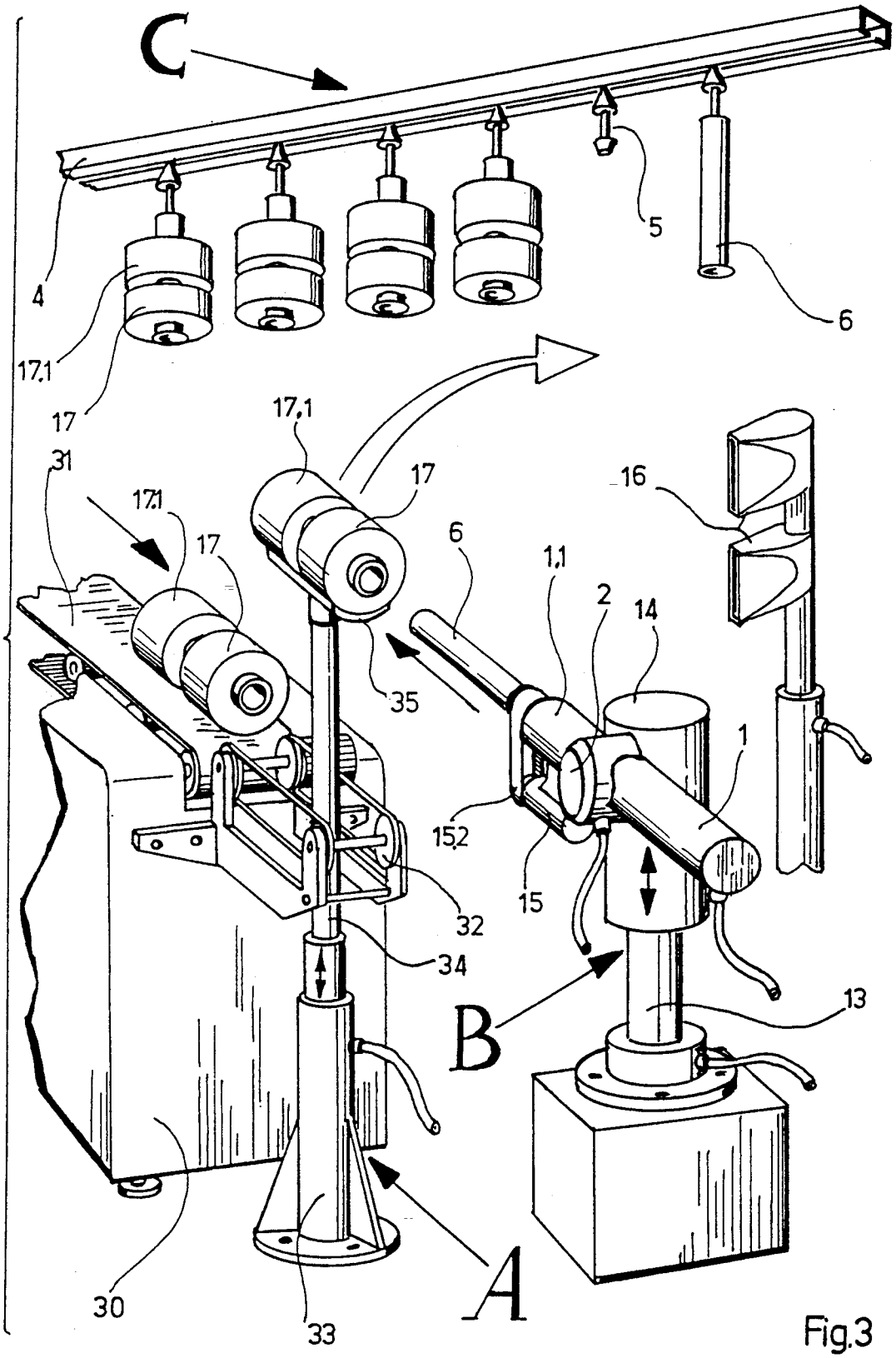
FIG. 3 is a side view of the apparatus of the present invention in a second working position with a preceding package repository.
Figure 4:
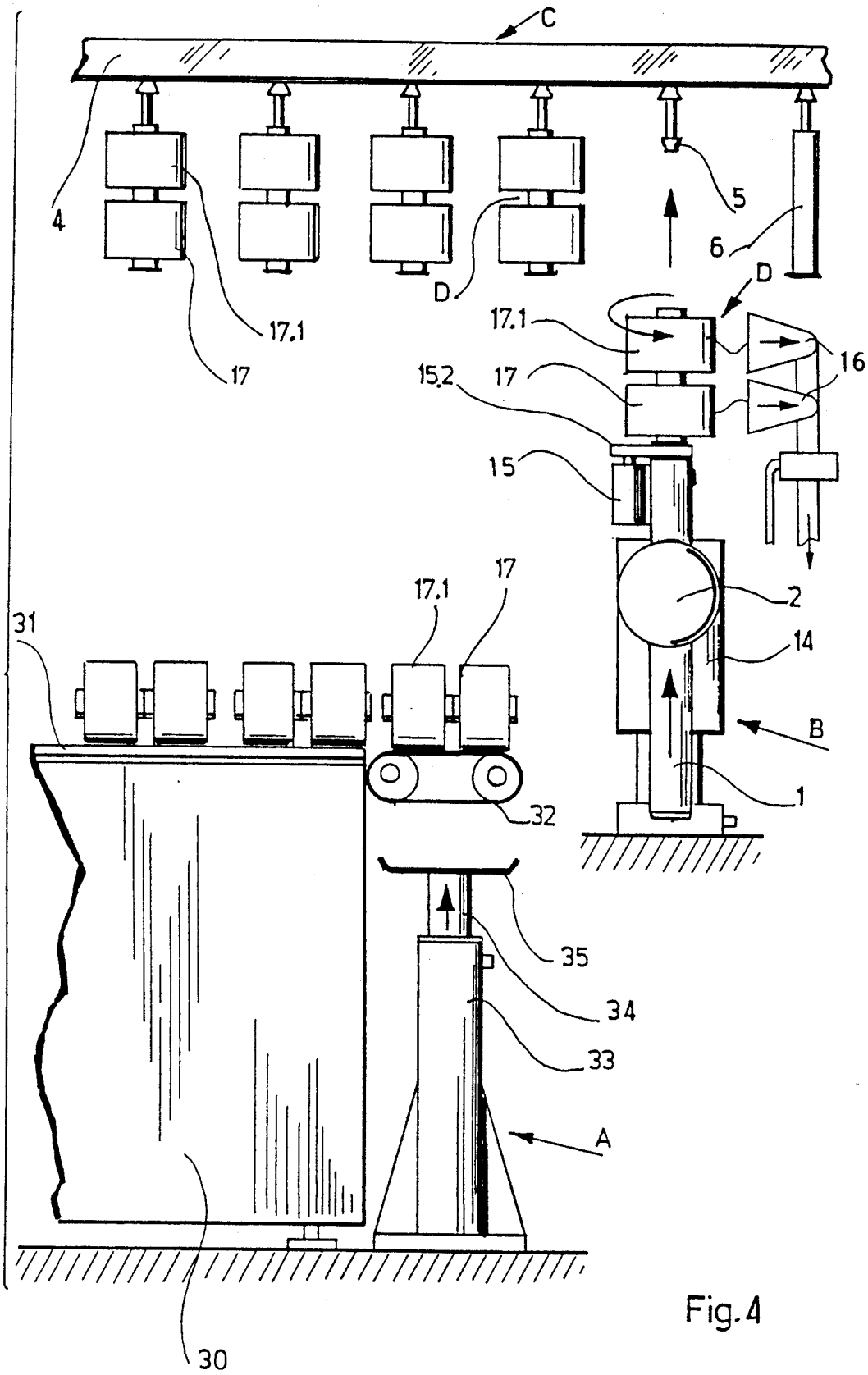
FIG. 4 is a side view of the apparatus of the present invention in a third working position with a preceding package repository.

35 As shown in FIGS. 2–4, the apparatus of the present invention comprises three individual assemblies, namely a package supply assembly A, a transferring assembly B, and an overhead conveying system C.

The package supply assembly A comprises as substantial individual components, a machine frame 30 with a horizontal conveying device 31 for supplying individual packages or groups 17, 17.1 thereof. It further includes a belt conveyor 32 and a lifting mechanism 33, the retractable lifting element 34 of which accommodates a package repository 35. The belt conveyor 32, the retractable lifting element 34 and the package repository 35 are designed and constructed such that, as is shown in FIG. 4, the packages 17, 17.1 supplied by the belt conveyor 32 can be removed from the latter by the upward movement of the package repository 35 and raised, for example, to a position as shown in FIGS. 2 and 3.

The transferring assembly B comprises a stationary column 13, along which a slide 14 Can be moved upward and downward. The slide 14 carries a rotary knob 2 rotatable about a horizontal axis, to which a lifting cylinder unit 1 with a lifting element 1.1 adapted to advance and retract is attached. According to FIG. 1, a package adapter carrier 7 comprising a stop plate s and a mandrel 9, is mounted on this movable lifting element 1.1.

The package transport system in the form of an overhead conveyor C comprises an upper rail 4, along which a conveyor chain or belt travels, from which evenly spaced-apart package holders 5 suspend.

With reference to the above-described constructional elements, the working principle of the present invention can be described as follows: The transferring assembly B moves the slide 14 and, in addition, the movable lifting element 1.1 upward to such an extent that the mandrel 9 enters into the lower end of a package adapter 6 which is carried by a package holder 5. To release the package adapter 6 from the holder 5, same is constructed in known manner such that the package adapter 6 is released therefrom upon an adequate upward movement relative to the suspended holder.

As soon as the package adapter 6 is released from the holder 5, the slide 14 lowers to a position shown in FIG. 3 until the horizontal axis of the rotatable knob 2 is at the same height as the substantially horizontally aligned axes of the packages 17, 17.1 placed on the package repository 35. Then, the rotatable knob 2 is actuated, thereby rotating the lifting cylinder unit 1 from its vertically upright position to a horizontally extending position, so as to be able to move the package adapter 6 into the packages 17, 17.1 by biasing the lifting cylinder unit 1 with pressure. Then, the rotary knob is again reset such that the lifting cylinder unit 1 assumes again its vertical initial position.

This situation is shown in FIG. 4, in which for reasons of simplification the distance between the package supply assembly A and the transferring assembly B are shown, contrary to the actual conditions, at a reduced scale.

As soon as the lifting cylinder unit 1 is returned to its vertical position, the package unit D comprising the two packages 17, 17.1 and package adapter 6 can again be delivered to a free holder 5 by an upward movement of slide 14.

Subsequently, the slide 14 lowers again to such an extent that the lower end of the package adapter 6 disengages from the mandrel 9, so the last-delivered package unit D can be advanced by one step. As a result thereof, the next package adapter arrives in the area of the transferring assembly B, so that the described working cycle can start again, i.e., the package adapter 6 is removed from the suspended holder 5, etc.

It is obvious that a package unit D may also comprise only one package 17 and one adapter 6 in the place of two packages and one adapter 6.

Additional individual elements are provided so as to prepare the package units for a further automated handling during their transfer or in the course of the package delivery.

Figure 8:
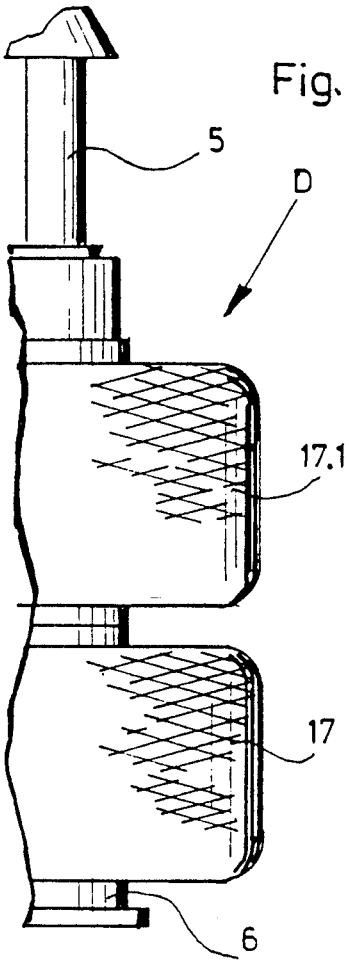
FIG. 8 is a view of a package unit comprising two packages and an adapter with a package holder.
Figure 1:
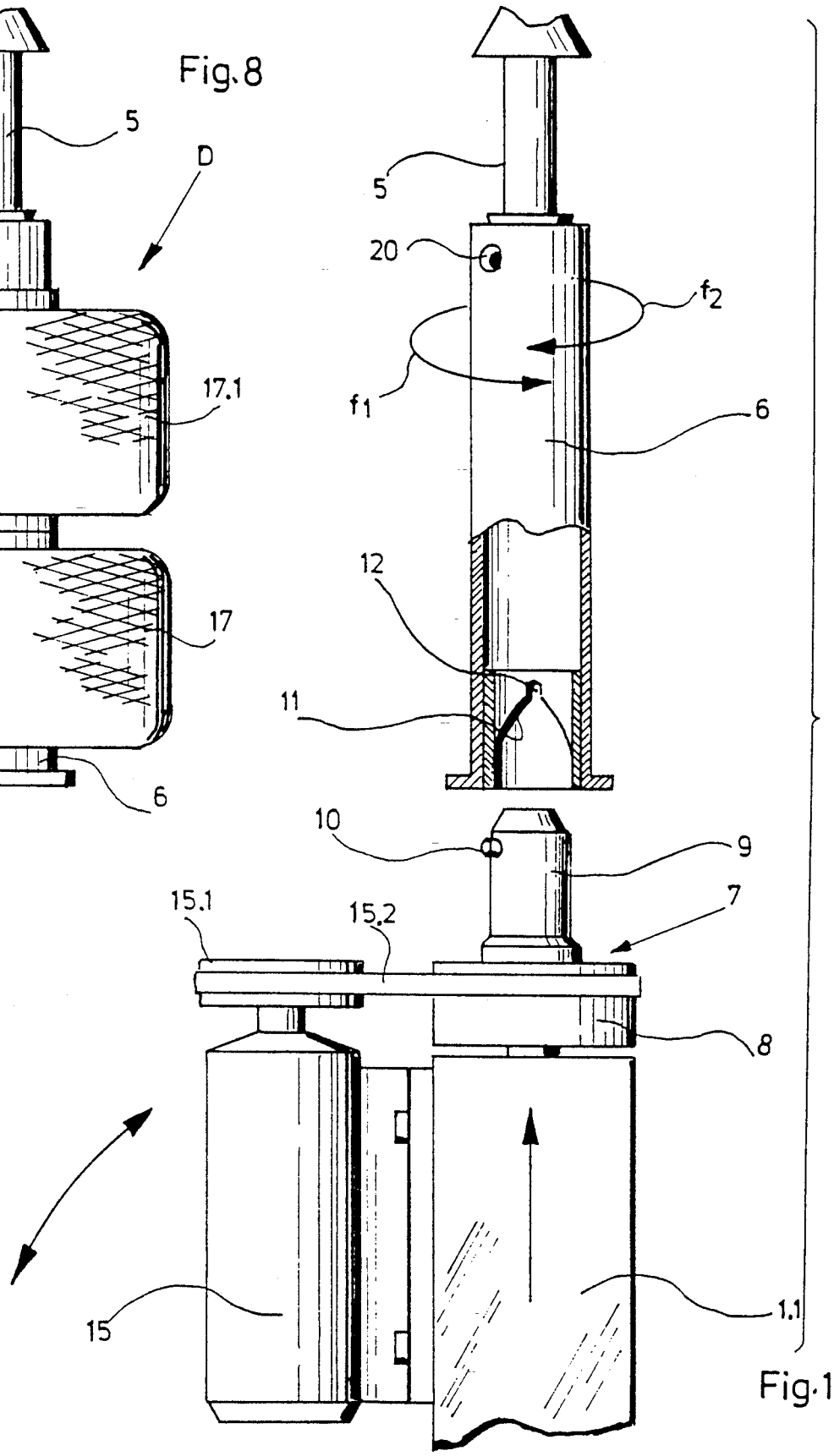
FIG. 1 is a schematic view partially cut of a package adapter with an associated adapter positioning device.

As is shown in FIG. 1, the mandrel 9 is provided with a preferably radially directed positioning pin 10, whereas the package adapter comprises on its inner side obliquely and/or spirally extending guide surfaces 11 and a downwardly open groove 12. As the mandrel 9 moves into the adapter 6, the latter is rotated in direction of arrows f1 or f2 by the interaction of the guide surfaces 11 with the positioning pin 10 of the package adapter, until the positioning pin engages in groove 12. As a result, a certain relative position is achieved between the package adapter 6 and the mandrel 9, when the latter enters into the adapter 6.

Attached to the retractable lifting element 1.1 is a rotatable drive 15 with a pulley 15.1 and a drive belt 15.1 Which is guided over the pulley 15.1. Furthermore, the drive belt 15.2 is placed around the stop plate 8 of the package adapter carrier 7 such that the carrier 7 can be rotated by this drive, for example, together with the package assembly D placed thereon.

This possibility of rotating the carrier or respectively the package unit D serves the purpose of locating the free yarn ends, after a suction device 16 is moved to the outer surfaces of the packages 17, 17.1, and sucking same into the suction device. The suction device 16 may comprise one or several suction nozzles with elongate, vertically aligned suction slots, which can be moved individually or jointly to the packages 17, 17.1 After the suction device 16 is moved to the package unit D and biased with suction air, the package unit D is put into rotation until, for example, optical scanning elements not shown detect that the yarns of the two packages 17 and 17.1 are sucked into the suction device.

Figure 5:
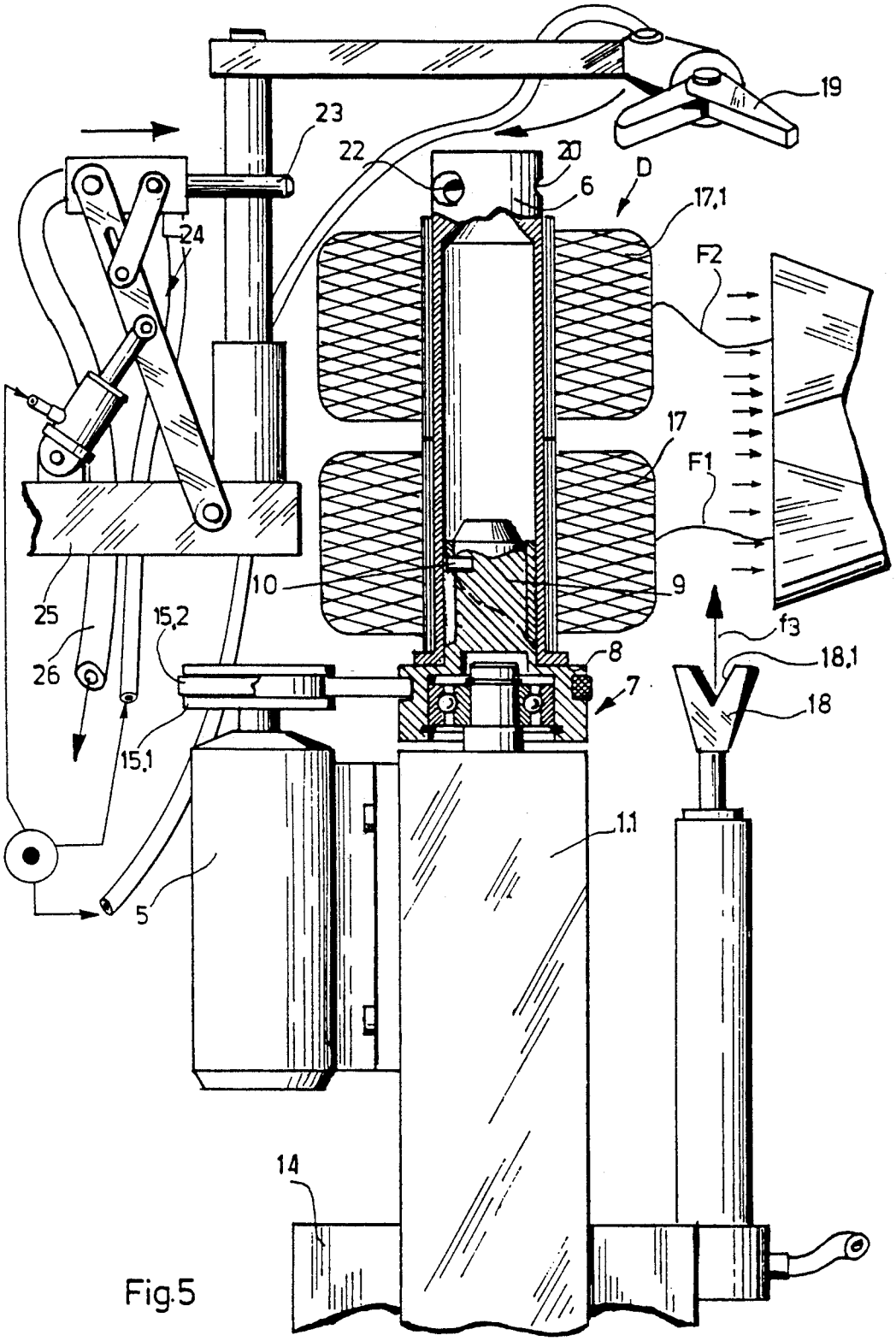
FIG. 5 is an enlarged detail view partially cut of the apparatus of the present invention with further individual elements associated therewith.

A yarn entrainment means is shown in FIG. 5 is arranged in such a manner that its notch 18.1 which has, for example, a V-shape, grasps the yarns F1 and F2, which continue to be under tension as a result of the suction effect of suction device 16, and carries same upward to a yarn clamp 19, which may be operated either pneumatically or electrically for the purpose of grasping and clamping the two yarns.

After having grasped the two yarns, the yarn clamp 19 approaches the upper end of the package adapter by means of suitable horizontal and vertical carriers and setting elements associated thereto in such a manner that the two yarns Fl and F2 can be guided to an opening 20 located at the upper end of the package adapter 6.

Figure 6:
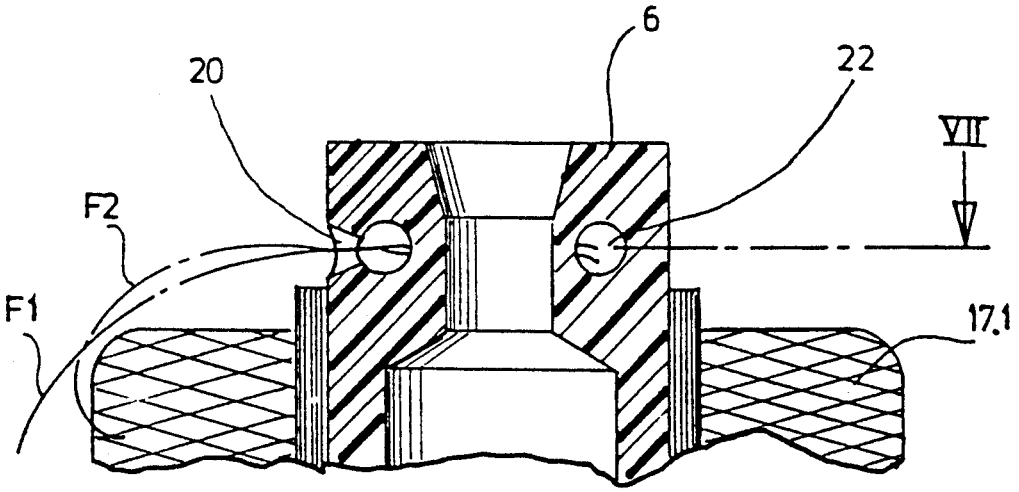
FIG. 6 is an enlarged sectional detail view of the upper end of the adapter as used in the present invention with a package shown in part.
Figure 7:
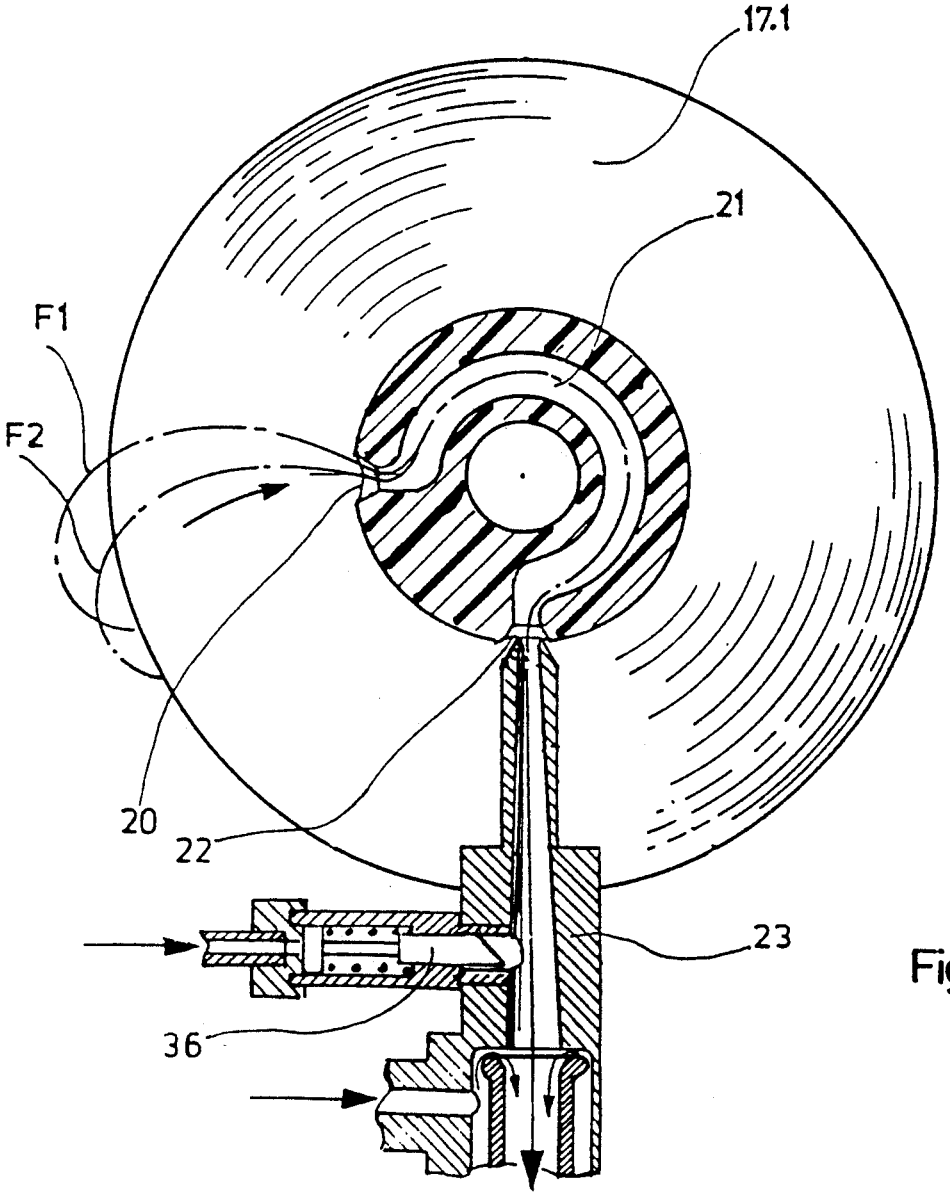
FIG. 7 is a cross sectional view along the line VII with an associated suction nozzle.

According to FIGS. 6 and 7, this first opening 20 is followed by a yarn guide channel 21 extending in circumferential direction over a predetermined circumferential angle and leading to a second opening 22 in the jacket surface of the package adapter 6. This second opening 22 can receive the front end of a suction nozzle 23, which is supported on a bracket 25 of the machine frame by means of lifting rods 24. The suction nozzle 23 connects to a hose 26. The inside of the suction nozzle accommodates a cutting device 36, so as to cut the sucked-in yarns at a defined length.

As soon as both yarns F1 and F2 are guided by the yarn clamp 19 to the inlet Opening 20 of the adapter, and when the suction nozzle 23 is biased with suction air after its entry into the opening 22 the two yarns having been released from the yarn clamp 19 can be sucked by the suction air into nozzle 23 substantially in dependence on the yarn lengths, which have previously been taken into the suction device 16.

After the suction air which is operative in the area of the suction nozzle 23, is cut off, the suction nozzle moves again away from the package adapter 6, so that the ends of the two yarns Fl and F2 hang out of the outlet opening 22 at defined, uniform lengths.

The suction of the yarns Fl and F2 into the openings of the package adapter serves to make the two yarn ends available at a certain defined position for further automatic handling processes.

Both the significance of positioning the adapter with regard to its angular position relative to the package adapter carrier 7 and the significance of the rotary drive 15 thus become relevant from the entire context, inasmuch as it matters that the openings 20 and 22 of the adapter are moved to a required opposition relative to the yarn clamp 19 on the one hand and the suction nozzle 23 on the other, and that the suction device 16 is enabled to locate the yarns F1 and F2. It is presumed that in each instance of searching or locating the yarns F1 and F2 by the suction device 16 the package adapter carrier 7 and, thus, the package unit D are driven to always perform full rotations.

As may be clearly seen in the drawings, operating movements of various components of the yarn package transfer mechanism of this invention, including the suction device 16, yarn clamp 19, suction nozzle 23, cutting device 36, etc., may be accomplished by the use of the illustrated fluid-operated piston and cylinder mechanisms. The design of such operating mechanisms is within the skill of one skilled in the art.

What is claimed is:

1. Yarn package transfer apparatus including means for removing hollow yarn package adapter devices from downwardly and generally vertically-extending package holders movably and serially-mounted on an overhead conveying system, for inserting such hollow adapter device into the hollow tubes of a desired number of yarn packages positioned in a generally horizontal position in a package supply assembly, and for transferring such packages of yarn from the package supply assembly and mounting the hollow adapter device and yarn packages carried thereby onto the vertically-extending package holder of the overhead conveying system for conveying of the yarn packages; said means comprising:

a generally vertically oriented stationary column and slide means mounted thereon for upward and downward movement;

a knob means mounted on said slide means for movement therewith and for rotating movement with respect thereto; and a cylinder and lifting element means mounted thereon for advancing and retracting movement, said cylinder and lifting element being carried by said knob means for rotating movement between a generally vertically-oriented position and a generally horizontally-oriented position, said lifting element means having carrier means on an outer end for removably receiving and carrying the adapter device.

2. Apparatus, as set forth in claim 1, in which said apparatus further includes means for positioning the loose ends of yarn from the yarn packages on the adapter device in desired positions during the transferring operation.

3. Yarn package transfer apparatus including:

means for removing hollow yarn package adapter devices from downwardly and generally vertically-extending package holders movably and serially-mounted on an overhead conveying system, for inserting such hollow adapter devices into the hollow tubes of a desired number of yarn packages positioned in a generally horizontal position in a package supply assembly, and for transferring such packages of yarn from the package supply assembly and mounting the hollow adapter devices and yarn packages carried thereby onto the vertically-extending package holders of the overhead conveying system for conveying of the yarn packages; and means for positioning the loose ends of yarn from the yarn packages on the adapter device in desired positions during the transferring operation.

4. Apparatus, as set forth in claim 2 or 3, in which the hollow yarn package adapter device includes an entrance opening in its outside surface at an upper end thereof which protrudes beyond the yarn packages carried thereby, a yarn channel extending at one end from the entrance opening generally circumferentially through the wall of the adapter device and an exit opening communicating with the other end of the yarn channel, and in which said loose yarn end positioning means includes first means for grasping and holding the loose yarn ends from the yarn packages on the adapter device, second means for transferring the held yarn ends from said first means to the entrance opening at the upper end of the adapter device, and third means for threading the loose ends of yarn through the yarn channel and out of the exit opening.

5. Apparatus, as set forth in claim 4, in which said first means of said positioning means includes means for rotating said package adapter device carrier means for desired positioning of the yarn package on the adapter device for grasping and holding by said first means.

6. Apparatus, as set forth in claim 5, in which first means of said positioning means further includes suction means positioned with respect to said package adapter carrier device when said cylinder and lifting element means are in the generally vertically-oriented position for grasping and holding the loose ends of yarn from the yarn packages which have been positioned by said rotating means.

7. Apparatus, as set forth in claim 6, in which said suction means comprises a separate suction device for each yarn packages positioned on the adapter device, each of said suction devices having an elongate slot adapted to be aligned vertically along the outside surface of each of the yarn packages.

8. Apparatus, as set forth in claim 4, in which said second means of said positioning means includes entrainment means for carrying the yarn from said first means of said positioning means, clamping such yarn and carrying the yarn ends to the entrance opening at the upper end of the adapter device.

9. Apparatus, as set forth in claim 4, in which said third means of said positioning means comprises movable suction nozzle means adapted to be moved into and out of engagement with the exit opening of the yarn channel in the hollow yarn package adapter device for applying a suction through the yarn channel and the yarn entrance opening for threading of the yarn therethrough.

10. Apparatus, as set forth inn claim 9, in which said suction nozzle means includes a hollow interior for receiving the loose yarn ends threaded through the yarn channel of the adapter device and further includes cutting means positioned within said suction nozzle means for cutting the loose ends received therein to provide uniform lengths on the cut yarn ends threaded through the adapter device.

11. Apparatus, as set forth in claim 4, in which said package adapter device carrier means comprises a mandrel insertable into the lower end of the hollow package adapter device, and in which said yarn end positioning means includes means on said mandrel for cooperating with said adapter device to position said adapter device thereon in a defined angular position to place the yarn entrance opening in desired position to receive the yarn ends from said second means of said yarn end positioning means.

12. Apparatus, as set forth in claim 11, in which the hollow adapter device is provided with inside guide surfaces extending obliquely and/or spirally and terminating in a downwardly-extending open groove, and inn which said means on said mandrel cooperating with said adapter device to position said adapter device thereon in a defined angular position comprises a pin extending from the surface of said mandrel in a generally radial direction.

13. Yarn package transfer apparatus including:

means for removing hollow yarn package adapter devices from downwardly and generally vertically-extending package holders movably and serially-mounted on an overhead conveying system, for inserting such hollow adapter devices into the hollow tubes of a desired number of yarn packages positioned in a generally horizontal position in a package supply assembly and for transferring such packages of yarn from the package supply assembly and mounting the hollow adapter devices and yarn packages carried thereby onto the vertically-extending package holder of the overhead conveying system for conveying of the yarn packages, each of the hollow yarn package adapter device includes an entrance opening in the outside surface at an upper end thereof which protrudes beyond the yarn packages carried thereby, a yarn channel extending at one end from the entrance opening generally circumferentially through the wall of the adapter device and an exit opening communicating with the other end of the yarn channel, said means comprising a generally vertically oriented stationary column and slide means mounted thereon for upward and downward movement, a knob means mounted on said slide means for movement therewith and for rotating movement with respect thereto, and a cylinder and lifting element mans mounted thereon for advancing and retracting movement and being carried by said knob means for rotating movement between a generally vertically-oriented position and a generally horizontally-oriented position and having carrier means comprising a mandrel on an outer end of said lifting element means for removably receiving and carrying the adapter device; and means for positioning the loose ends of yarn from the yarn packages on the adapter device through the yarn channel and out of the exit opening in the upper end of the adapter device, said yarn end positioning means including first means for grasping and holding the loose yarn ends from the yarn packages on the adapter device which comprises means for rotating said package adapter device carrier means for desired positioning of the yarn package on the adapter device and suction means positioned with respect to said package adapter carrier device when said cylinder and lifting element means are in the generally vertically-oriented position for grasping and holding the loose ends of yarn from the yarn packages which have been positioned by said rotating means, second means for transferring the held yarn ends from said suction means of said first means to the entrance opening at the upper end of the adapter device and comprising entrainment means for carrying the yarn from said suction means of said first means and clamp means for receiving the yarn from said entrainment means, clamping said yarn and carrying the yarn ends from said suction means of said first means to the entrance opening of the yarn channel at the upper end of the adapter device, and third means for threading of the loose ends of yarn through the yarn channel and out of the exit opening and comprising movable suction nozzle means adapted to be moved into and out of engagement with the exit opening of the yarn channel in the adapter device for applying a suction through the yarn channel and the yarn entrance opening for threading of the yarn ends therethrough.

14. Apparatus, as set forth inn claim 13, in which said suction nozzle means includes a hollow interior for receiving the loose yarn ends threaded through the yarn channel of the adapter device and further includes cutting means positioned within said suction nozzle means for cutting the loose ends received therein to provide uniform lengths on the cut yarn ends threaded through the adapter device.

15. Apparatus, as set forth in claim 13 or 14, in which said package adapter device carrier means comprises a mandrel insertable into the lower end of the hollow package adapter device, and in which said yarn end positioning means includes means on said mandrel for cooperating with said adapter device to position said adapter device thereon in a defined angular position to place the yarn entrance opening in desired position to receive the yarn ends from said second means of said yarn end positioning means.

16. Apparatus, as set forth in claim 15, in which the hollow adapter device s provided with inside guide surfaces extending obliquely and/or spirally and terminating in a downwardly-extending open groove, and in which said means on said mandrel cooperating with said adapter device to position said adapter device thereon in a defined angular position comprises a pin extending from the surface of said mandrel in a generally radial direction.

* * * * *

UNITED STATES PATENT AND TRADEMARK OFFICE

CERTIFICATE OF CORRECTION

PATENT NO. : 5,082,192

DATED : January 21, 1992

INVENTOR(S) : Langen et al

It is certified that error appears in the above-indentified patent and that said Letters Patent is hereby corrected as shown below:

At column 3, line 12, please delete "inn" and substitute --in-- therefore.

At column 3, line 53, please delete --35-- before "As".

At column 4, line 4, delete "Can" and substitute --can-- therefore.

At column 4, line 9, delete "s" and substitute --8-- therefore.

At column 5, line 57, delete "Opening" and substitute --opening--.

UNITED STATES PATENT AND TRADEMARK OFFICE

CERTIFICATE OF CORRECTION

PATENT NO. : 5,082,192

DATED : January 21, 1992

INVENTOR(S) : Langen et al

It is certified that error appears in the above-indentified patent and that said Letters Patent is hereby corrected as shown below:

At column 7, line 50, after "means" insert --and clamp means for receiving the yarn from said entrainment means,--.

At column 7, line 61, delete "inn" and substitute --in-- therefore.

At column 8, line 15, delete "inn" and substitute --in-- therefore.

At column 8, line 47, delete "mans" and substitute --means-- therefore.

Signed and Sealed this

Fourteenth Day of June, 1994

Bruce Lehman

*Attest:*

BRUCE LEHMAN

*Attesting Officer*

*Commissioner of Patents and Trademarks*